US012426666B2

(12) United States Patent
Cheney et al.

(10) Patent No.: US 12,426,666 B2
(45) Date of Patent: Sep. 30, 2025

(54) RAPID-ENTRY FOOTWEAR HAVING A SPLIT BACK

(71) Applicant: FAST IP, LLC, Lindon, UT (US)

(72) Inventors: Craig Cheney, Lindon, UT (US); Bradley Johnson, Draper, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/827,952

(22) Filed: May 30, 2022

(65) Prior Publication Data

US 2022/0287406 A1 Sep. 15, 2022

Related U.S. Application Data

(63) Continuation of application No. PCT/US2021/059496, filed on Nov. 16, 2021.

(60) Provisional application No. 63/116,395, filed on Nov. 20, 2020.

(51) Int. Cl.

| | |
|---|---|
| ***A43B 11/00*** | (2006.01) |
| ***A43B 3/24*** | (2006.01) |
| ***A43B 23/02*** | (2006.01) |
| ***A43B 23/08*** | (2006.01) |

(52) U.S. Cl.

CPC ..... *A43B 11/00* (2013.01); *A43B 3/242* (2013.01); *A43B 23/027* (2013.01); *A43B 23/088* (2013.01)

(58) Field of Classification Search

USPC ..... 36/105

See application file for complete search history.

(56) References Cited

U.S. PATENT DOCUMENTS

| | | | | |
|---|---|---|---|---|
| 112,439 | A | 3/1871 | Francis | |
| 287,312 | A | 10/1883 | Packard | |
| 736,156 | A | 8/1903 | Roberts | |
| 808,948 | A | 1/1906 | Roberts et al. | |
| 827,330 | A | 7/1906 | Tillson | |
| 863,549 | A | 8/1907 | Metz | |
| 881,153 | A | 3/1908 | Rickert | |
| 921,461 | A | 5/1909 | Rickert | |
| 923,860 | A | 6/1909 | Kroell | |
| 1,081,678 | A | 12/1913 | Langerak | |
| 1,110,624 | A * | 9/1914 | Guiffre | A43B 23/047 36/51 |
| 1,116,462 | A | 11/1914 | Moran | |
| 1,266,620 | A | 5/1918 | Maurice | |

(Continued)

FOREIGN PATENT DOCUMENTS

| | | |
|---|---|---|
| CN | 2438353 | 7/2001 |
| CN | 1403041 | 3/2003 |

(Continued)

OTHER PUBLICATIONS

Interntional Search Report and Written Opinion dated Jan. 31, 2022 in PCT International Patent Application No. PCT/US2021/059496.

(Continued)

*Primary Examiner* — Jila M Mohandesi

(57) ABSTRACT

A rapid-entry shoe having a heel counter to prevent inward deflection of a rear portion of the upper, but the heel counter having a vertical slit to permit downward deflection of the rear portion of the upper, so as to expand a perimeter of an opening of the shoe to receive a foot and thereby facilitate donning and doffing of the rapid-entry shoe.

9 Claims, 3 Drawing Sheets

(56) References Cited

U.S. PATENT DOCUMENTS 1,464,342 A 8/1923 Rothacher
1,494,236 A 5/1924 Greathouse
1,686,175 A 10/1928 Read
1,926,818 A 9/1933 Ratcliff
1,945,420 A * 1/1934 Charles ..... A43B 3/166 D2/915
2,024,766 A * 12/1935 Ingwer ..... A43B 3/16 36/50.1
2,069,752 A 2/1937 Dorr
2,083,390 A * 6/1937 Murena ..... A43C 11/006 D2/978
2,118,019 A 5/1938 Benjafield
2,188,603 A * 1/1940 Hamalainen ..... A43B 3/16 36/138
2,266,732 A 12/1941 Babinchak
2,297,594 A 9/1942 Weinstat
2,368,514 A 1/1945 Baehr
2,450,250 A 9/1948 Napton
2,452,502 A 10/1948 Tarbox
2,693,039 A * 11/1954 Balut ..... A43B 3/101 36/51
2,736,110 A * 2/1956 Hardimon ..... A43B 23/08 36/58.5
2,763,071 A 9/1956 Kingsley
2,829,448 A 4/1958 Minera
2,920,402 A 1/1960 Minera
2,945,309 A * 7/1960 Shapiro ..... A43B 5/06 36/89
3,000,116 A 9/1961 Ally
3,014,288 A 12/1961 Evans et al.
3,040,454 A 6/1962 Topper et al.
3,097,438 A 7/1963 Evans
3,146,535 A * 9/1964 Owings ..... A43B 11/00 36/58.6
3,192,651 A 7/1965 Smith
3,373,512 A * 3/1968 Jacobson ..... A43B 3/16 36/7.1 R
3,643,350 A 2/1972 Paoletta et al.
3,798,802 A 3/1974 Saunders
4,489,509 A 12/1984 Libit
4,590,690 A 5/1986 Pfander
4,596,080 A 6/1986 Benoit et al.
4,805,321 A 2/1989 Tonkel
4,811,502 A 3/1989 Barret
4,924,605 A 5/1990 Spademan
4,972,613 A 11/1990 Loveder
4,979,319 A 12/1990 Hayes
5,054,216 A 10/1991 Lin
5,090,140 A 2/1992 Sessa
5,127,170 A 7/1992 Messina
5,174,050 A 12/1992 Gabrielli
5,181,331 A 1/1993 Berger
5,184,410 A 2/1993 Hamilton
5,257,470 A 11/1993 Auger et al.
5,259,126 A 11/1993 Rosen
5,265,353 A 11/1993 Marega et al.
5,282,327 A 2/1994 Ogle
5,311,678 A 5/1994 Spademan
5,341,583 A 8/1994 Hallenbeck
5,351,583 A 10/1994 Szymber et al.
5,353,526 A 10/1994 Foley et al.
5,371,957 A 12/1994 Gaudio
5,430,961 A 7/1995 Faulconer et al.
5,467,537 A 11/1995 Aveni et al.
5,481,814 A 1/1996 Spencer
5,806,208 A 9/1998 French
5,842,292 A 12/1998 Siesel
5,846,063 A 12/1998 Lakic
5,983,530 A 11/1999 Chou
5,997,027 A 12/1999 Jungkind
6,000,148 A 12/1999 Cretinon
6,014,823 A 1/2000 Lakic
6,125,555 A 10/2000 Schenkel
6,128,837 A 10/2000 Huang
6,170,173 B1 1/2001 Caston
6,189,239 B1 2/2001 Gasparovic et al.
6,290,559 B1 9/2001 Scott
6,321,466 B1 11/2001 Bordin et al.
6,360,454 B1 3/2002 Dachgruber
6,367,171 B1 4/2002 Burt
6,378,230 B1 4/2002 Rotem et al.
6,470,537 B1 10/2002 Schallenkamp
6,643,954 B2 11/2003 Voswinkel
6,671,980 B1 1/2004 Liu
6,684,533 B1 2/2004 Su
6,839,985 B2 1/2005 Bettiol
6,877,252 B2 4/2005 Wilkinson
6,922,917 B2 8/2005 Kerns
6,925,732 B1 * 8/2005 Clarke ..... A43B 7/141 36/31
6,938,361 B2 9/2005 Su
6,988,328 B2 * 1/2006 Rosen ..... A43B 3/18 36/73
7,059,068 B2 6/2006 Magallanes et al.
7,103,994 B2 9/2006 Johnson
7,178,270 B2 2/2007 Hurd et al.
7,225,563 B2 6/2007 Chen
7,439,837 B2 10/2008 McDonald
D583,956 S 12/2008 Chang et al.
7,661,205 B2 2/2010 Johnson
7,685,747 B1 3/2010 Gasparovic et al.
7,757,414 B2 7/2010 Tonkel
7,793,438 B1 9/2010 Busse et al.
7,823,299 B1 11/2010 Brigham
7,975,403 B2 7/2011 Mosher
D648,512 S 11/2011 Schlageter
8,065,819 B2 11/2011 Kaufman
8,087,188 B2 1/2012 Labbe
8,161,669 B2 4/2012 Keating
8,225,535 B2 7/2012 Dillenbeck
8,302,329 B2 11/2012 Hurd et al.
8,333,021 B2 * 12/2012 Johnson ..... A43B 3/14 36/11
8,499,474 B2 8/2013 Kaufman
8,745,901 B2 * 6/2014 Toraya ..... A43B 23/26 36/1
8,769,845 B2 7/2014 Lin
9,119,441 B2 9/2015 Frappier
9,254,014 B2 * 2/2016 Weitzman ..... A43B 3/04
9,314,067 B2 4/2016 Bock
9,351,532 B2 5/2016 Mokos
9,456,652 B2 * 10/2016 Davis ..... A43B 23/047
9,615,624 B2 4/2017 Kilgore et al.
9,629,416 B2 4/2017 Rackiewicz et al.
9,635,905 B2 5/2017 Dekovic
9,675,132 B2 6/2017 Marshall
9,717,304 B2 8/2017 Bernhard et al.
9,820,527 B2 11/2017 Pratt et al.
9,877,542 B2 1/2018 Pratt
9,999,278 B2 6/2018 Feinstein
10,306,947 B2 6/2019 Pratt et al.
10,327,515 B2 6/2019 Peyton et al.
D854,303 S 7/2019 Flanagan et al.
10,455,898 B1 10/2019 Orand et al.
10,499,707 B2 12/2019 Hobson et al.
10,506,842 B2 12/2019 Pratt et al.
10,537,154 B2 1/2020 Smith et al.
10,555,578 B2 2/2020 Pratt
10,568,382 B2 2/2020 Hatfield et al.
10,568,385 B2 * 2/2020 Beers ..... A43B 11/02
10,609,981 B1 4/2020 Phinney
10,617,173 B2 * 4/2020 Twist ..... A43B 3/02
10,617,174 B1 4/2020 Hopkins et al.
10,638,810 B1 * 5/2020 Cheney ..... A43B 3/248
10,653,209 B2 5/2020 Pratt et al.
10,660,401 B1 5/2020 Pratt et al.
10,765,167 B2 * 9/2020 Azoulay ..... A43B 11/00
10,791,796 B1 10/2020 Baker
10,813,405 B2 10/2020 Pratt
10,905,192 B1 2/2021 Cheney
10,912,348 B2 2/2021 Owings et al.
10,973,278 B2 4/2021 Raia
10,973,279 B2 * 4/2021 Cheney ..... A43B 3/00

(56) References Cited

U.S. PATENT DOCUMENTS 11,000,091 B1 5/2021 Kyle
11,140,941 B2 10/2021 Xanthos et al.
11,154,113 B2 10/2021 Hatfield et al.
11,172,727 B2 11/2021 Hatfield et al.
11,191,320 B2 12/2021 Happen
11,213,098 B2 * 1/2022 Beers ..... A43B 11/02
11,234,482 B2 2/2022 Roser
D948,190 S 4/2022 Jury
D948,191 S 4/2022 Holmes
D949,540 S 4/2022 Jury
D949,544 S 4/2022 Witherow
D955,732 S 6/2022 Kelley
11,464,287 B2 * 10/2022 Kilgore ..... A43B 23/088
11,617,410 B1 * 4/2023 Kim ..... A43B 23/047 36/105
11,633,005 B2 4/2023 Pratt et al.
11,633,006 B2 4/2023 Pratt et al.
11,633,016 B2 4/2023 Orand et al.
11,659,886 B2 5/2023 Cheney et al.
11,700,916 B2 7/2023 Kilgore et al.
11,707,113 B2 7/2023 Hopkins et al.
D993,601 S 8/2023 Wang et al.
11,737,511 B2 8/2023 Cheney et al.
11,744,319 B2 9/2023 Farina
2001/0001350 A1 5/2001 Aguerre
2002/0053147 A1 5/2002 Borsoi et al.
2002/0066213 A1 6/2002 Wells
2002/0095823 A1 7/2002 Laio et al.
2002/0144434 A1 10/2002 Farys
2002/0174568 A1 11/2002 Neiley
2003/0106244 A1 6/2003 Miller et al.
2004/0003517 A1 1/2004 Marvin et al.
2004/0088890 A1 5/2004 Matis et al.
2004/0111921 A1 6/2004 Lenormand
2005/0022428 A1 2/2005 Anderson
2005/0034328 A1 2/2005 Geer
2005/0039348 A1 2/2005 Raluy et al.
2005/0066543 A1 * 3/2005 Rosen ..... A43B 3/18 36/7.5
2005/0076540 A1 4/2005 Su
2005/0198867 A1 9/2005 Labbe
2005/0241189 A1 * 11/2005 Elkington ..... A43B 5/0409 36/117.6
2006/0156587 A1 * 7/2006 Pawlus ..... A43B 3/24 36/100
2007/0074425 A1 4/2007 Leong
2007/0180730 A1 8/2007 Greene et al.
2007/0209234 A1 9/2007 Chou
2007/0256329 A1 11/2007 Antonelli et al.
2007/0271822 A1 11/2007 Meschter
2007/0277394 A1 12/2007 Hansen et al.
2008/0086911 A1 4/2008 Labbe
2008/0189984 A1 8/2008 Januszewski et al.
2008/0276492 A1 11/2008 Burnett
2008/0307673 A1 12/2008 Johnson
2008/0313929 A1 12/2008 Hoyt
2009/0090026 A1 4/2009 Mosher
2010/0037483 A1 2/2010 Meschter et al.
2010/0095494 A1 4/2010 Martin
2010/0095554 A1 4/2010 Gillespie
2010/0251572 A1 10/2010 Baudouin et al.
2011/0016751 A1 1/2011 Somerville
2011/0146106 A1 6/2011 Kaufman
2011/0185592 A1 8/2011 Nishiwaki et al.
2011/0214313 A1 9/2011 James et al.
2011/0239489 A1 10/2011 Iuchi et al.
2011/0277350 A1 11/2011 Huynh
2012/0055044 A1 3/2012 Dojan et al.
2012/0060395 A1 3/2012 Blevens et al.
2012/0151799 A1 6/2012 Weinreb
2012/0167413 A1 7/2012 Marvin et al.
2012/0186106 A1 * 7/2012 Recchi ..... A43B 23/047 36/102
2012/0216429 A1 8/2012 Bastida et al.
2012/0317839 A1 12/2012 Pratt
2013/0160328 A1 6/2013 Hatfield et al.
2013/0185959 A1 7/2013 Coleman
2013/0219747 A1 8/2013 Lederer
2013/0312285 A1 * 11/2013 Sharma ..... A43B 23/0295 36/100
2014/0013624 A1 1/2014 Stockbridge et al.
2014/0090274 A1 4/2014 Arquilla
2014/0101975 A1 4/2014 Ueda
2014/0123516 A1 5/2014 Cressman et al.
2014/0173932 A1 6/2014 Bell
2014/0189964 A1 7/2014 Wen et al.
2014/0202044 A1 7/2014 Adami et al.
2014/0259781 A1 9/2014 Sakai
2014/0298687 A1 * 10/2014 Flinterman ..... A43B 13/141 36/103
2014/0305005 A1 10/2014 Yeh
2014/0373396 A1 12/2014 Chang
2015/0013184 A1 1/2015 Beers
2015/0013189 A1 1/2015 Hanak et al.
2015/0020416 A1 1/2015 Wiens
2015/0047222 A1 2/2015 Rushbrook
2015/0047223 A1 2/2015 Flinterman et al.
2015/0165338 A1 6/2015 Choe
2015/0216252 A1 * 8/2015 Wiens ..... A43B 1/0054 36/105
2015/0305432 A1 10/2015 Wiens
2015/0305442 A1 10/2015 Ravindran
2016/0007674 A1 1/2016 Labonte et al.
2016/0128424 A1 5/2016 Connell et al.
2016/0128429 A1 5/2016 Hatfield et al.
2016/0262492 A1 9/2016 Fujita et al.
2016/0302530 A1 10/2016 Smith et al.
2016/0374427 A1 12/2016 Zahabian
2017/0013915 A1 1/2017 Caston, Jr.
2017/0035148 A1 2/2017 Marvin et al.
2017/0127755 A1 5/2017 Bunnell et al.
2017/0215525 A1 8/2017 Labbe
2017/0265562 A1 * 9/2017 Mullen ..... A43B 13/223
2017/0303632 A1 * 10/2017 Pratt ..... A43B 23/0275
2017/0360141 A1 * 12/2017 Azoulay ..... A43B 11/00
2017/0360143 A1 12/2017 Pratt
2017/0360151 A1 12/2017 Pratt
2018/0110287 A1 4/2018 Hopkins et al.
2018/0110292 A1 * 4/2018 Beers ..... A43B 23/088
2018/0199659 A1 7/2018 Lintaman
2018/0235314 A1 8/2018 Farage
2018/0255865 A1 9/2018 Hsu
2018/0263332 A1 9/2018 Bruno
2018/0289109 A1 10/2018 Beers et al.
2018/0295942 A1 10/2018 Drake
2018/0338572 A1 11/2018 Cross et al.
2018/0343968 A1 12/2018 James et al.
2019/0053571 A1 2/2019 Bjornson et al.
2019/0116916 A1 4/2019 Burch
2019/0281920 A1 9/2019 Ito et al.
2019/0289960 A1 9/2019 Loveder
2019/0297999 A1 10/2019 Nakaya et al.
2019/0307208 A1 10/2019 Corcoran-Tadd et al.
2019/0365029 A1 12/2019 Cross et al.
2019/0366667 A1 12/2019 Cross et al.
2020/0015544 A1 1/2020 Pratt
2020/0037703 A1 2/2020 Twist
2020/0046066 A1 2/2020 Difrancisco
2020/0068991 A1 3/2020 Steere et al.
2020/0085136 A1 3/2020 Pratt et al.
2020/0113274 A1 4/2020 Butler
2020/0187590 A1 6/2020 Hopkins et al.
2020/0196703 A1 * 6/2020 Hopkins ..... A43B 23/047
2020/0196787 A1 6/2020 Dament et al.
2020/0205511 A1 7/2020 Hopkins et al.
2020/0205512 A1 7/2020 Blanche et al.
2020/0205516 A1 7/2020 Kilgore
2020/0205518 A1 7/2020 Hopkins et al.
2020/0205520 A1 7/2020 Kilgore
2020/0245797 A1 8/2020 Kim
2020/0253333 A1 8/2020 Kilgore et al.
2020/0305552 A1 10/2020 Cheney et al.
2020/0323308 A1 10/2020 Dubuisson

(56) References Cited

U.S. PATENT DOCUMENTS

| | | | | |
|---|---|---|---|---|
| 2020/0375319 | A1 | 12/2020 | Yang | |
| 2020/0383424 | A1 | 12/2020 | Hughes | |
| 2021/0059351 | A1 | 3/2021 | Piacentini | |
| 2021/0068493 | A1 | 3/2021 | Pratt et al. | |
| 2021/0068494 | A1 | 3/2021 | Zahabian | |
| 2021/0068498 | A1 | 3/2021 | Cheney et al. | |
| 2021/0106094 | A1 | 4/2021 | Cheney | |
| 2021/0112911 | A1 | 4/2021 | Pratt et al. | |
| 2021/0112914 | A1 | 4/2021 | Cheney | |
| 2021/0112916 | A1 | 4/2021 | Schulten | |
| 2021/0127788 | A1 | 5/2021 | Li | |
| 2021/0145114 | A1 | 5/2021 | Kyle | |
| 2021/0169177 | A1 | 6/2021 | Yang | |
| 2021/0186146 | A1 | 6/2021 | Erwin | |
| 2021/0204642 | A1* | 7/2021 | Kyle | A43B 23/028 |
| 2021/0204643 | A1 | 7/2021 | Kyle | |
| 2021/0204644 | A1 | 7/2021 | Kyle | |
| 2021/0204645 | A1 | 7/2021 | Pratt | |
| 2021/0227923 | A1 | 7/2021 | Love et al. | |
| 2021/0235811 | A1 | 8/2021 | Oh | |
| 2021/0282495 | A1 | 9/2021 | Davis et al. | |
| 2021/0321718 | A1 | 10/2021 | Chang | |
| 2021/0330033 | A1 | 10/2021 | Pratt et al. | |
| 2021/0337922 | A1 | 11/2021 | Cheney | |
| 2021/0345727 | A1 | 11/2021 | Raia | |
| 2022/0104582 | A1 | 4/2022 | Christensen et al. | |
| 2022/0132976 | A1* | 5/2022 | Bentz | A43B 5/18 36/1.5 |
| 2022/0142291 | A1 | 5/2022 | Cheney et al. | |
| 2022/0240625 | A1 | 8/2022 | Shin | |
| 2022/0287407 | A1 | 9/2022 | Cheney et al. | |
| 2022/0354220 | A1 | 11/2022 | Cheney | |
| 2022/0361627 | A1 | 11/2022 | Cheney et al. | |
| 2022/0369758 | A1 | 11/2022 | Pratt | |
| 2022/0378144 | A1 | 12/2022 | Pratt et al. | |
| 2022/0400810 | A1* | 12/2022 | Cheney | A43B 21/26 |
| 2023/0030016 | A1 | 2/2023 | Pratt et al. | |
| 2023/0033366 | A1 | 2/2023 | Farina | |
| 2023/0035573 | A1 | 2/2023 | Bar | |
| 2023/0052916 | A1 | 2/2023 | Bar | |
| 2023/0055164 | A1 | 2/2023 | Cheney et al. | |
| 2023/0077572 | A1 | 3/2023 | Dean et al. | |
| 2023/0081272 | A1 | 3/2023 | Pratt | |
| 2023/0084256 | A1 | 3/2023 | Brilliant | |
| 2023/0218033 | A1 | 7/2023 | Cheney | |
| 2023/0225450 | A1 | 7/2023 | Cheney et al. | |
| 2023/0263270 | A1 | 8/2023 | Jones | |
| 2023/0276897 | A1 | 9/2023 | Cheney et al. | |
| 2023/0284737 | A1 | 9/2023 | Bar | |

FOREIGN PATENT DOCUMENTS

| | | | |
|---|---|---|---|
| CN | 201005111 | | 1/2008 |
| CN | 101991227 | A | 3/2011 |
| CN | 107467775 | A | 12/2017 |
| DE | 19534249 | | 3/1997 |
| DE | 19611797 | | 10/1997 |
| DE | 29809404 | | 8/1998 |
| DE | 10247163 | | 10/2002 |
| DE | 102004005288 | | 8/2005 |
| EP | 1059044 | | 12/2000 |
| EP | 1952715 | A1 | 8/2008 |
| EP | 3266327 | A1 | 1/2018 |
| FR | 3066679 | A1 | 11/2018 |
| GB | 2517399 | | 8/2013 |
| JP | 181910 | | 6/1989 |
| JP | 11-127907 | A | 5/1999 |
| JP | 2001149394 | | 6/2001 |
| JP | 2006055571 | | 3/2006 |
| JP | 2010-104416 | A | 5/2010 |
| JP | 2014-161721 | A | 9/2014 |
| KR | 10-2005-0095542 | A | 9/2005 |
| KR | 10-2009-0093548 | A | 9/2009 |
| KR | 10-2009-0130804 | A | 12/2009 |
| KR | 100936510 | | 1/2010 |
| NL | 2000762 | C1 | 1/2009 |
| WO | 2007080205 | | 7/2007 |
| WO | 2009089572 | | 7/2009 |
| WO | 2009154350 | | 12/2009 |
| WO | 2017004135 | | 1/2017 |
| WO | 2018/230961 | A1 | 12/2018 |
| WO | 2019/215359 | A1 | 11/2019 |
| WO | 2020/006490 | A1 | 1/2020 |
| WO | 2020/176653 | A1 | 9/2020 |
| WO | 2021/162569 | A1 | 8/2021 |
| WO | 2022/221339 | A1 | 10/2022 |
| WO | 2023/049414 | A1 | 3/2023 |
| WO | 2023/064568 | A1 | 4/2023 |

OTHER PUBLICATIONS

U.S. Appl. No. 62,186,148, filed Jun. 29, 2015, Zahabian.

Sneider, "Kizik Handsfree New York Shoe Review," https://the-gadgeteer.com/2018/06/27/kizik-handsfree-new-york-show-review/ (2018).

https://www.teva.com/kids-sandals/hurricane-drift/ 1102483C.html submitted herewith as of Jun. 13, 2019.

https://us.ecco.com/ecco-biom-fjuel-mens-outdoor-shoe-837594.html?dwvar_837594_color=00001 submitted herewith as of Jun. 1, 2016.

International Preliminary Report on Patentability received for PCT Patent Application No. PCT/US21/059496, mailed on Jun. 1, 2023, 6 pages.

* cited by examiner

RAPID-ENTRY FOOTWEAR HAVING A SPLIT BACK

CROSS-REFERENCE TO RELATED APPLICATION

This application is a continuation of, claims priority to and the benefit of PCT Serial No. PCT/US21/59496 filed Nov. 16, 2021 and entitled "RAPID-ENTRY FOOTWEAR HAVING A SPLIT BACK." PCT Serial No. PCT/US21/59496 claims the benefit of U.S. Provisional Patent Application No. 63/116,395, filed Nov. 20, 2020 and entitled "RAPID-ENTRY FOOTWEAR HAVING A SPLIT BACK." All of the aforementioned applications are incorporated herein by reference in their entireties.

FIELD

The present disclosure relates to footwear, and more particularly to rapid-entry footwear having a split back.

BACKGROUND

Whether due to inconvenience or inability, donning and doffing of shoes, including tying or otherwise securing the same, may be undesirable and/or present difficulties to some individuals. The present disclosure addresses this need.

SUMMARY

A rapid-entry shoe in accordance with the present disclosure comprises a sole portion, an upper, and a heel counter coupled to the upper. The heel counter can be configured to prevent inward deflection of a rear portion of the upper.

In example embodiments, the heel counter comprises a vertical slit configured to permit downward deflection of the rear portion of the upper.

In example embodiments, the rapid-entry shoe has an uncollapsed configuration. In example embodiments, in the uncollapsed configuration, the vertical slit is substantially closed.

In example embodiments, the rapid-entry shoe has a collapsed configuration to facilitate donning and doffing of the rapid-entry shoe. In example embodiments, in the collapsed configuration, the vertical slit is open to create an aperture and expand a perimeter of the heel counter.

In example embodiments, the rapid-entry shoe is biased by the heel counter toward the uncollapsed configuration.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
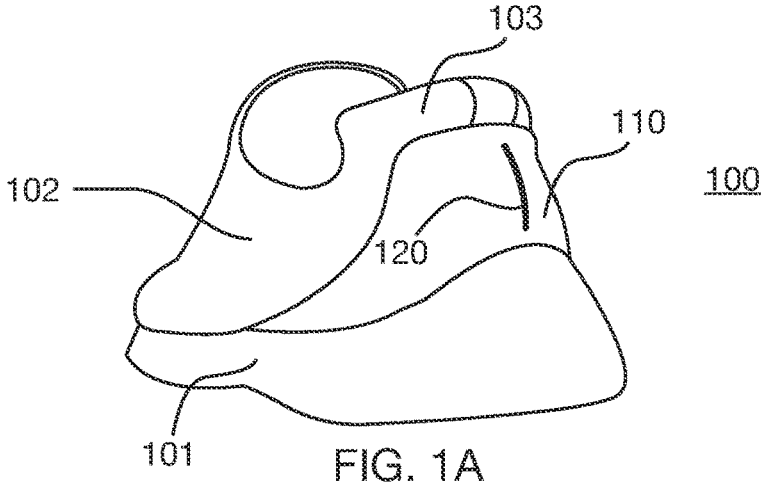
FIGS. 1A-1C progressively illustrate an example embodiment of a rapid-entry shoe moving from an uncollapsed configuration to a collapsed configuration.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, unless the context dictates otherwise, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, unless the context dictates otherwise, a "sole portion" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe, for example, an insole or an internal cushion.

As used herein, unless the context dictates otherwise, a "rear portion of an upper" refers to any rear portion of an upper, for example, a heel portion or backstrap, including a topline thereof.

Figure 1B:
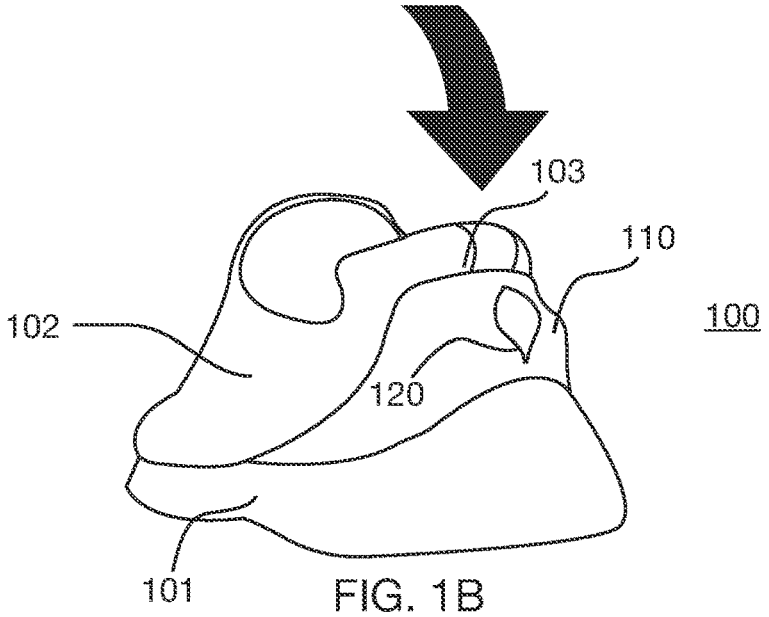
Figure 1C:
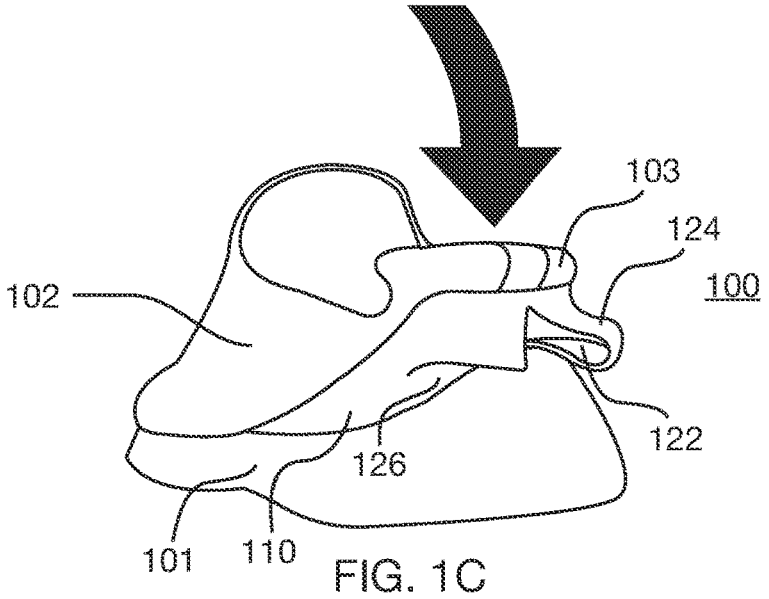

With reference to FIGS. 1A-1C, a rapid-entry shoe 100 in accordance with the present disclosure comprises a sole portion 101 and an upper 102.

A rapid-entry shoe 100 in accordance with the present disclosure further comprises a heel counter 110 coupled to the upper 102, the heel counter 110 configured to prevent inward deflection of a rear portion 103 of the upper 102. In example embodiments, the heel counter 110 is coupled to the upper 102 at an edge or other lateral portion of the heel counter 110 (i.e., but not at a middle or other medial portion of the heel counter 110).

In accordance with example embodiments, the heel counter 110 is sandwiched within the upper 102, while in other example embodiments, the heel counter 110 is coupled to a single side of the upper 102 (e.g., an outer surface, as illustrated, or an inner surface of the upper 102).

In accordance with example embodiments of the present disclosure, the heel counter 110 is one or more of semi rigid, resiliently deformable, elastically deformable, and comprised of a shape memory material.

In accordance with example embodiments of the present disclosure, return of the shoe 100 to the uncollapsed configuration (discussed below) is assisted by a secondary system, for example, a deformable element or a compressible lattice structure.

In accordance with an example embodiment of the present disclosure, the heel counter 110 comprises a slit 120 (e.g., a vertical slit), or a plurality of slits, configured to permit downward deflection of the rear portion 103 of the upper 102 of the shoe 100 toward the sole portion 101.

As used herein, unless the context dictates otherwise, a "slit" refers to a split, cut or other opening passing through or extending completely from one side to another (e.g., to expose or reveal an ornamental feature on underlying the upper 102), or a material or portion thereof weaker or thinner (e.g., scored or perforated) than an adjacent material or portion thereof. Additionally, while a slit can be linear, a slit can also be non-linear (e.g., be y-shaped or be comprised of one or more zig-zags, curves, waves or the like). A slit 120 can also be at an angle (i.e., not vertical, as illustrated). A slit 120 can be formed with a mechanical implement (e.g., a blade), a heat implement (e.g., a laser), or otherwise.

In example embodiments, an upper end of the slit 120 does not extend to an outer edge of the heel counter 110. In other example embodiments, a lower end of the slit 120 does not extend to an outer edge of the heel counter 110. In still other example embodiments, neither end of the slit 120 extends to an outer edge of the heel counter 110.

In accordance with example embodiments, a slit 120 can be reinforced, for example, with a spot weld or a stitch at one or both ends of the slit 120. In accordance with example embodiments, a slit 120 can comprise an enlarged portion (e.g., circular or y-shaped) at one or both ends of the slit 120 to accommodate lateral edges of the vertical slit 120 being bowed (discussed below).

Figure 2A:
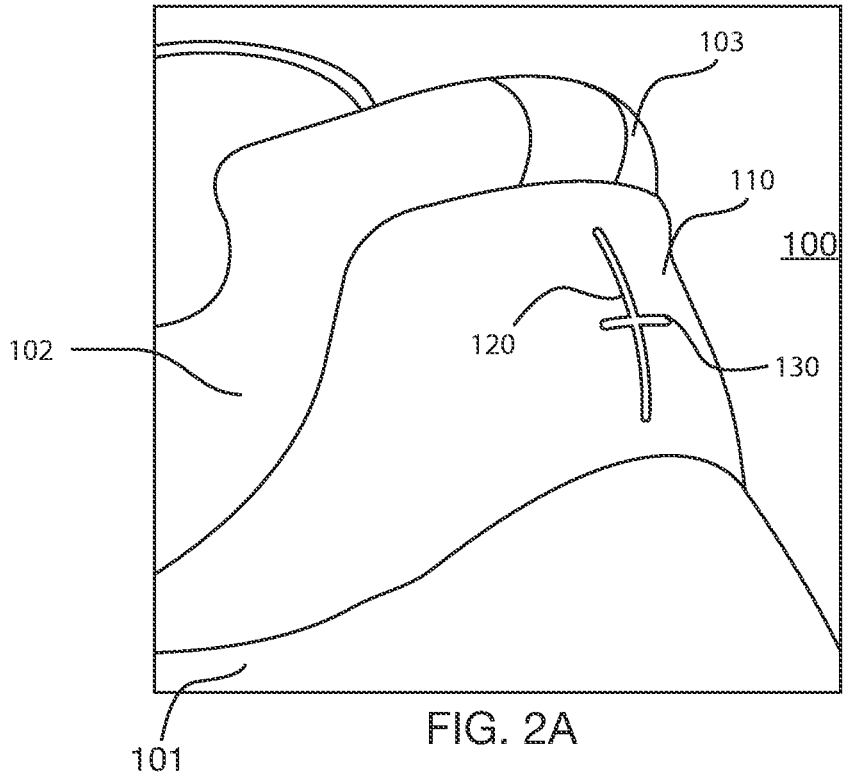
FIGS. 2A and 2B illustrate an example embodiment of another rapid-entry shoe having a slit in closed and open configurations, respectively.
Figure 2B:
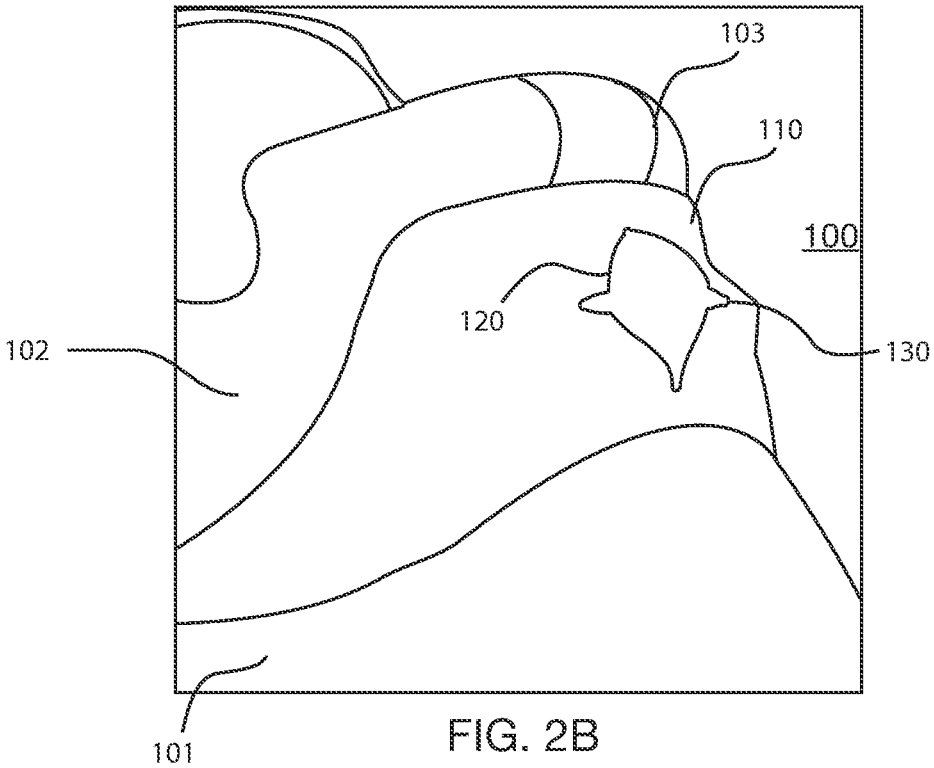

In accordance with another example embodiment of the present disclosure, and with momentary reference to FIGS. 2A and 2B, the heel counter 110 of a rapid-entry shoe 100 comprises a vertical slit 120 and an intersecting horizontal slit 130, together configured to permit downward deflection of the rear portion 103 of the upper 102 of the shoe 100 toward the sole portion 101. In combination, vertical slit 120 and horizontal slit 130 form a contiguous t-shaped slit.

Figure 3A:
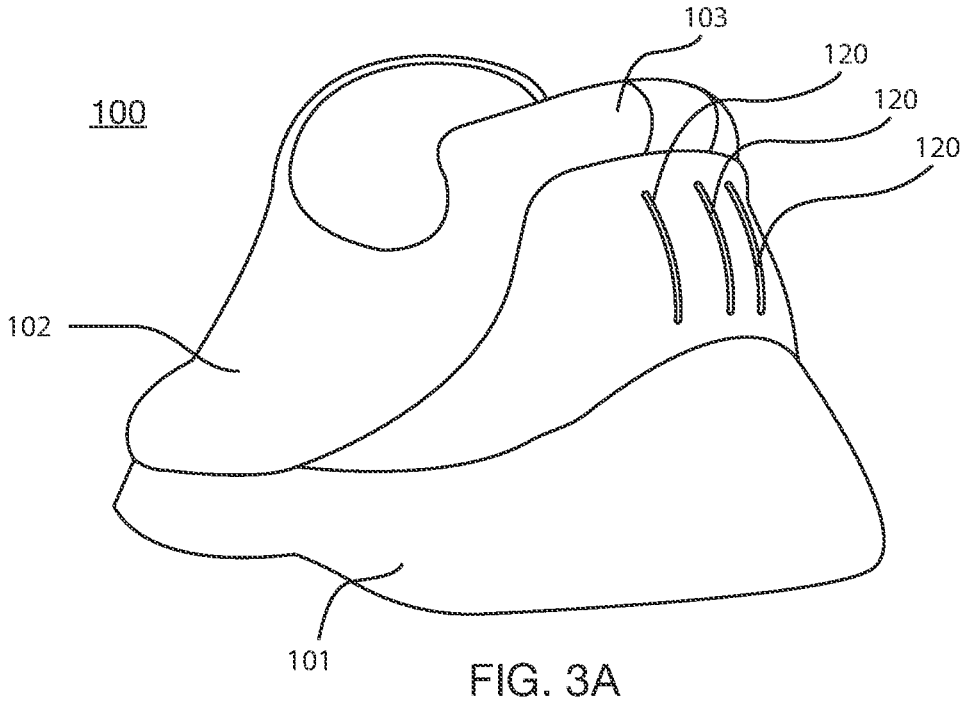
FIGS. 3A and 3B illustrate an example embodiment of a rapid-entry shoe having a plurality of slits in closed and open configurations, respectively.
Figure 3B:
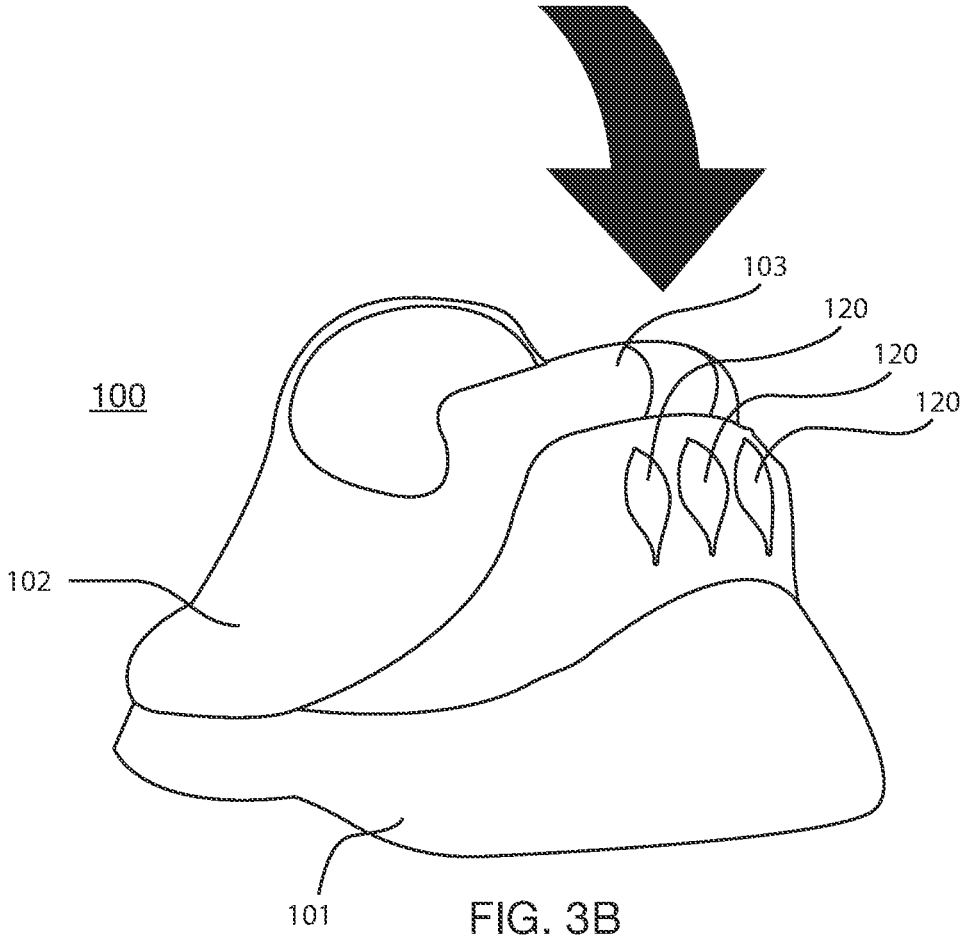

FIGS. 3A and 3B illustrate an example embodiment of a rapid-entry shoe 100 having a plurality of vertical and parallel slits 120 that work together to permit downward deflection of the rear portion 103 of the upper 102 of the shoe 100 toward the sole portion 101.

Optionally, and in connection with any of the foregoing embodiments, a rapid-entry shoe 100 in accordance with the present disclosure can further comprise a rear stabilizer coupled to the rear portion 103, the rear stabilizer configured to prevent inward deflection of the rear portion 103.

In general, the rear stabilizer can be configured to direct a rear portion of an upper to compress downward and/or lean rearward (and prevent a rear portion of an upper from deflecting inward, which would reduce the perimeter of the opening of rapid-entry shoe 100). In this regard, in example embodiments, the rear stabilizer is configured to prevent inward deflection of the rear portion 103 when the rapid entry shoe is deformed to the collapsed configuration.

In some embodiments, the rear stabilizer is v-shaped, u-shaped, horse-shoe-shaped (with consistent or inconsistent curvature as it rounds a rear portion of an upper), or otherwise has an elongated shape, and thus extends around a rear portion of an upper. The rear stabilizer can be coupled to an inside or outside surface of rear portion 103, or be embedded within rear portion 103.

In example embodiments, the rear stabilizer comprises a mechanical property different from that of an adjacent rear portion 103, the mechanical property being one or more of material, cross-section, thickness, geometry, twisting and density. For instance, the rear stabilizer can comprise a reinforced section of rear portion 103. In example embodiments, the rear stabilizer is more rigid than adjacent rear portion 103.

Without limiting the foregoing, in some embodiments the rear stabilizer can be comprised of a thicker or more dense section of the same material of which rear portion 103 is comprised, but geometrically adjusted to provide stability to rear portion 103.

Optionally, a rapid-entry shoe 100 in accordance with the present disclosure can further comprise a flare coupled to the rear portion 103, the flare extending rearward and acting as a shoehorn (e.g., to direct a foot into the foot opening during entry).

In accordance with example embodiments of the present disclosure, the rapid-entry shoe 100 has an uncollapsed configuration (FIG. 1A). In accordance with example embodiments of the present disclosure, the rapid-entry shoe 100 has a collapsed configuration (FIG. 1C) to facilitate donning and doffing of the rapid-entry shoe 100. In accordance with example embodiments of the present disclosure, the rapid-entry shoe 100 is biased by the heel counter 110 toward the uncollapsed configuration (FIG. 1A).

In accordance with example embodiments of the present disclosure, in the uncollapsed configuration (FIG. 1A), the vertical slit 120 is substantially closed (i.e., lateral edges of the vertical slit 120 are parallel or otherwise adjacent to one another).

In accordance with example embodiments of the present disclosure, in the collapsed configuration (FIG. 1C), opposing ends of the vertical slit 120 are moved toward one another such that lateral edges of the vertical slit 120 are bowed outward (e.g., laterally), not parallel or otherwise moved away from one another to thereby create an aperture 122 defined by lateral edges of the vertical slit 120, or otherwise open the vertical slit 120, and thereby expand a perimeter of the heel counter 110 (and in turn, expand a perimeter of an opening of the shoe to receive a foot). In example embodiments, in the collapsed configuration, a portion of the upper 102 is bowed away from (e.g., forwardly relative to, or rearwardly relative to as illustrated) a middle or other medial portion of the heel counter 110 (e.g., which can be bowed away in a generally opposing direction).

In example embodiments, in the uncollapsed configuration (FIG. 1A), the distance between lateral edges of the vertical slit 120 is less than the distance between opposing ends of the vertical slit 120.

In example embodiments, in the collapsed configuration (FIG. 1C), the distance between lateral edges of the vertical slit 120 is the same as or greater than the distance between opposing ends of the vertical slit 120.

In this regard, in some embodiments, in the collapsed configuration, a bowed portion 124 of the heel counter 110 is folded over a lower portion 126 of the heel counter 110 toward the sole portion 101. In some embodiments, in the collapsed configuration, a bowed portion 124 of the heel counter 110 is folded further, over a portion of the sole portion 101 (FIG. 1C). In other embodiments, in the collapsed configuration, the bowed portion 124 of the heel counter 110 is folded under the lower portion 126 of the heel counter 110 toward the sole portion 101.

In example embodiments, a resilient element is coupled between lateral edges of the vertical slit 120, and the resilient element is elongated in the collapsed configuration as lateral edges of the vertical slit 120 are bowed outward, not parallel or otherwise moved away from one another, so as to further bias the rapid-entry shoe 100 toward the uncollapsed configuration.

In example embodiments, the aperture 122 (i.e., when the shoe is in a partially collapsed or a collapsed configuration) has a marquise, football, pear, teardrop or other elongated elliptical shape with pointed ends.

In example embodiments, opening of the aperture 122 exposes or reveals an ornamental feature on the upper 102 (e.g., a different color, a design feature, a logo, or a portion of any of the foregoing, e.g., to combine with a corresponding portion on the heel counter 110).

In example embodiments, the aperture 122 is covered (e.g., on an inner surface and/or an outer surface) by a film to as to prevent dirt or debris from entering the aperture or otherwise provide an ornamental feature to the rapid-entry shoe 100.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe comprising:

a sole portion;

an upper having a rear portion coupled to the sole portion and extending around a heel of the rapid-entry shoe; and a heel counter extending between opposing sides of the shoe around the heel and coupled to an outer surface of the upper;

wherein the heel counter comprises a vertical slit configured to permit downward deflection of the rear portion of the upper;

wherein the rapid-entry shoe has an uncollapsed configuration;

wherein the rapid-entry shoe has a collapsed configuration to facilitate donning and doffing of the rapid-entry shoe;

wherein, in the uncollapsed configuration, the vertical slit is substantially closed;

wherein, in the collapsed configuration, the vertical slit is open to create an aperture through the heel counter open to the rear portion and expand a perimeter of the heel counter;

wherein the rapid-entry shoe is biased by the heel counter toward the uncollapsed configuration;

wherein, in the collapsed configuration, a bowed portion of the heel counter is folded over a lower portion of the heel counter;

wherein in the collapsed configuration opposing ends of the vertical slit are moved toward one another and lateral edges of the vertical slit are moved away from one another; and wherein the slit remains closed to a topline of the upper in both the uncollapsed configuration and the collapsed configuration.

2. The rapid-entry shoe of claim 1, further comprising an enlarged portion positioned at a first end of the vertical slit.

3. The rapid-entry shoe of claim 2, wherein the enlarged portion has a circular shape.

4. The rapid-entry shoe of claim 1, further comprising a horizontal slit that intersects the vertical slit.

5. The rapid-entry shoe of claim 1, further comprising a stitch provided at a first end of the vertical slit.

6. The rapid-entry shoe of claim 1, further comprising a stabilizer coupled to a rear portion of the upper.

7. The rapid-entry shoe of claim 1, wherein lateral edges of the vertical slit are bowed outward when the rapid-entry shoe moves toward the collapsed configuration.

8. A heel counter for a shoe, comprising:

at least one slit extending between a first location on the heel counter and a second location on the heel counter, the first location being removed from a first edge of the heel counter and the second location being removed from a second edge of the heel counter and wherein:

the slit is biased toward a closed position in which the slit is substantially closed; and the slit moves toward an open position in response to deformation of the heel counter and wherein movement toward the open position causes the slit to define an aperture and further wherein a bowed portion of the heel counter is folded over a lower portion of the heel counter when the slit is in the open position.

9. The heel counter of claim 8, further comprising a cover associated with the aperture.

* * * * *